US007631988B2

(12) United States Patent
Xie et al.

(10) Patent No.: US 7,631,988 B2
(45) Date of Patent: Dec. 15, 2009

(54) LED LAMP

(75) Inventors: Ye-Ke Xie, Shenzhen (CN); Yong-Dong Chen, Shenzhen (CN); Shih-Hsun Wung, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/134,160

(22) Filed: Jun. 5, 2008

(65) Prior Publication Data

US 2009/0244892 A1 Oct. 1, 2009

(30) Foreign Application Priority Data

Mar. 26, 2008 (CN) ..... 2008 1 0066348

(51) Int. Cl.
*F21V 29/00* (2006.01)

(52) U.S. Cl. ..... 362/294; 362/249.02; 362/373; 362/800

(58) Field of Classification Search ..... 362/800, 362/249.02, 294, 373, 545, 547
See application file for complete search history.

(56) References Cited

U.S. PATENT DOCUMENTS

| | | | | |
|---|---|---|---|---|
| 7,168,842 | B2 * | 1/2007 | Chou et al. | 362/631 |
| 2003/0147254 | A1 * | 8/2003 | Yoneda et al. | 362/551 |
| 2007/0025119 | A1 * | 2/2007 | Chang-Jien et al. | 362/555 |

* cited by examiner

*Primary Examiner*—Laura Tso
(74) *Attorney, Agent, or Firm*—Frank R. Niranjan

(57) ABSTRACT

An LED lamp comprises an envelope, two heat sinks respectively disposed at two opposite ends of the envelope, two LED modules respectively received in the two heat sinks, and two light guide plates respectively mounted in the two heat sinks and over the LED modules. Each light guide plate is located at a light route of the LED module to reflect light emitting from the LED module into several light beams. The light beams are first emitted into a central hole of the envelope, spread on an interior of the envelope around the central hole and radiate out of the LED lamp from an exterior of the envelope. The central hole has a round shape, while the exterior has a triangular shape.

17 Claims, 2 Drawing Sheets

LED LAMP

BACKGROUND OF THE INVENTION

1. Field of the Invention

The present invention relates to an LED lamp, and more particularly to an improved LED lamp having heat sinks, wherein light source of the LED lamp is embedded in the heat sinks to prevent a discomfortable glare. Furthermore, the LED lamp can have an even illumination and a large illumination area.

2. Description of Related Art

An LED lamp as a new type of light source can generate brighter light, and have many advantages, e.g., energy saving, environment friendly and longer life-span, compared to conventional light sources. Therefore, the LED lamp has a trend of substituting for conventional lamps.

A conventional LED lamp comprises a plate-shaped heat sink and an LED module attached to a bottom of the heat sink. In use of the LED lamp, light generated by the LED module directly irradiates to an outside of the LED lamp. Since LEDs of the LED module are conventionally arranged on a PCB of the LED module in a discrete matrix manner, the light emitted by the LEDs cannot radiate to an ambient environment uniformly and illumination area of the LED lamp is not large, which cause some troublesome problems, e.g., light beams with different light intensities, light glare and blackout of a user of the LED lamp. In addition, due to being mounted on the bottom of the heat sink, the light produced by the LED module can only project from the bottom of the heat sink and cannot illuminate other places around the LED lamp, whereby an application of the LED lamp is prohibited in some fields which need a large light illumination area, such as navigation light.

What is needed, therefore, is an LED lamp which can overcome the above-mentioned disadvantages.

SUMMARY OF THE INVENTION

An LED lamp comprises an envelope, two heat sinks respectively disposed at two opposite ends of the envelope, two LED modules respectively received in the two heat sinks, and two light guide plates respectively mounted in the two heat sinks and over the LED modules. Each light guide plate is located at a light route of the light emitted from the LED module, to thereby reflect the light emitted from the LED module into several light beams. Since the envelope is located between the two LED modules, the light beams reflected by the two light guide plates are spread on an interior of the envelope, from where the light can uniformly radiate to an outside around the LED lamp through an exterior of the envelope. By the guiding of the envelope, the light output of the LED lamp can be distributed over an overall space around the LED lamp, and the problem of the light glare or light beams with different intensities or a blackout of a user of the LED lamp is accordingly lessened.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
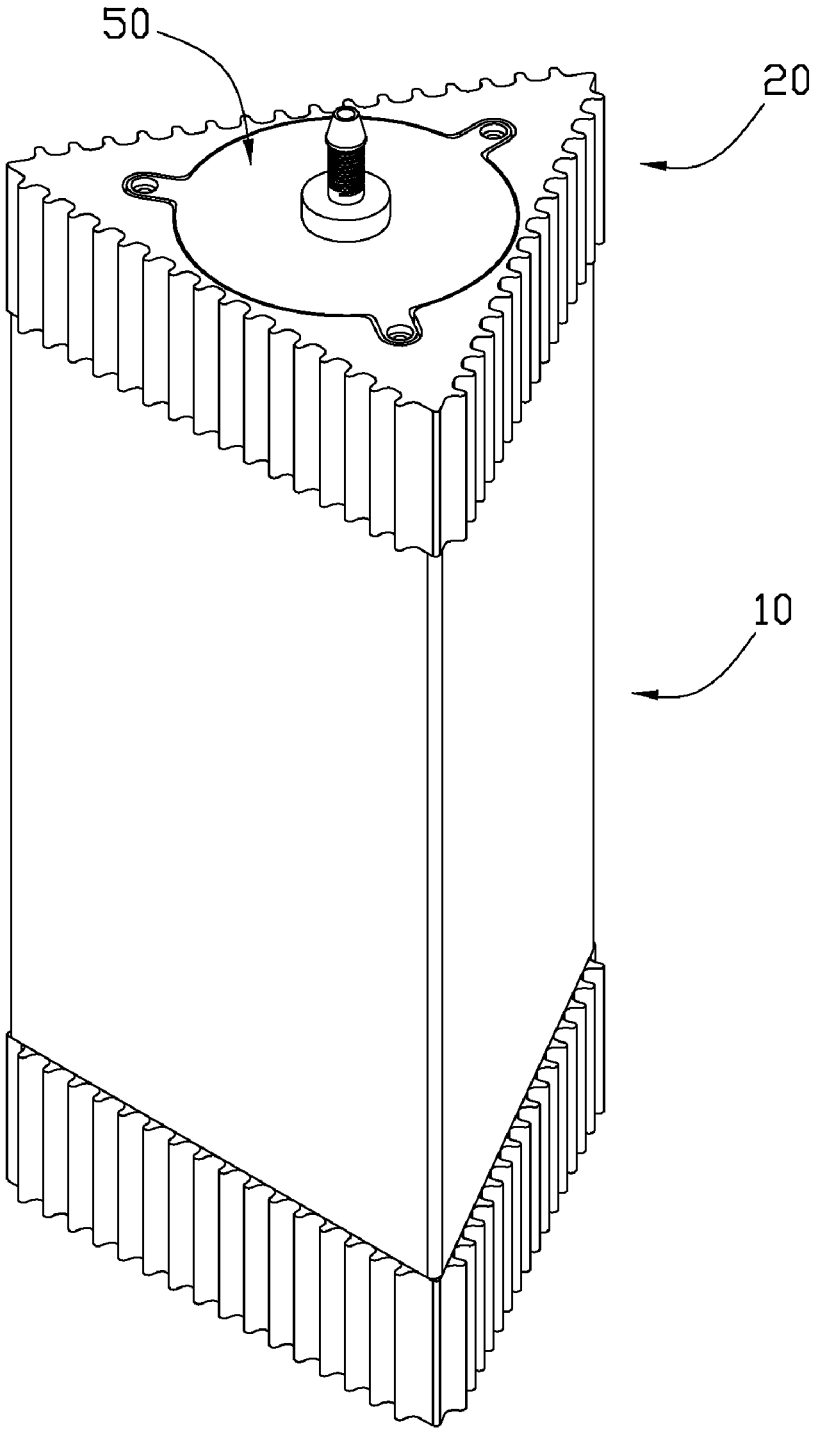
FIG. 1 is an isometric, assembled view of an LED lamp in accordance with a preferred embodiment of the present invention.
Figure 2:
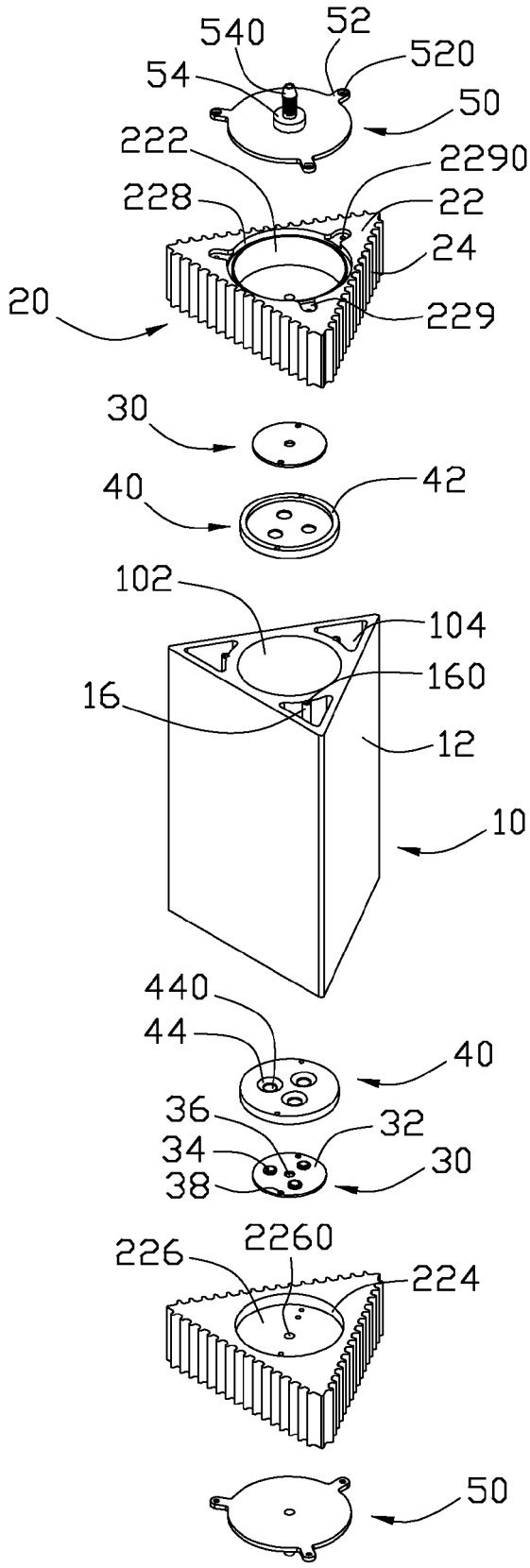
FIG. 2 is an exploded view of FIG. 1.

Referring to FIGS. 1-2, an LED lamp in accordance with a preferred embodiment of the present invention is used in a variety of applications, such as a street lamp, a garden lamp or an indoor lamp. The LED lamp comprises an envelope 10, two heat sinks 20 respectively disposed at two opposite ends of the envelope 10, two LED modules 30 respectively received in insides of the two heat sinks 20, two light guide plates 40 respectively received in the two heat sinks 20, and two covers 50 respectively mounted on the two heat sinks 20.

The envelope 10 has a triangular, prism-shaped configuration and made of transparent or semitransparent material, such as glass, to allow light to penetrate therethrough. The envelope 10 has three interconnected outer walls 12 and defines a circular through hole 102 in a central portion thereof for providing a route of light therethrough without being blocked or refracted. The envelope 10 also defines three through holes 104 around the through hole 102, located near three corners of the envelope 10. The three through holes 104 each have three inner walls (not labeled), wherein two neighboring inner walls are respectively parallel to and located next to two adjacent outer walls 12 of the envelope 10, while one inner wall has an arced-shape and is located next to the through hole 102. The arced inner walls of the envelope 10 defining the three through holes 104 each extend along a central axis of the envelope 10, and form an elongated post 16 therefrom along the axis of the envelope 10. Three fixing holes 160 are respectively defined in central portions of the three posts 16 to cooperate with three screws (not shown) to thereby fix a corresponding heat sink 20 on the envelope 10.

The heat sinks 20 each are made of a good heat conductive material, such as copper, and has a triangular, prism-shaped configuration, corresponding to the envelope 10. The heat sinks 20 are respectively located at the two opposite ends of the envelope 10, and each comprise a triangular prism base 22 and a plurality of fins 24 extending perpendicularly and outwardly from an outer periphery of the base 22. The base 22 defines two hollow circular chambers 222, 224. The chamber 222 of the base 22 of an upper heat sink 20 is located at a top end of the base 22 of the upper heat sink 20, facing the cover 50 to receive a rectifier (not shown) therein. The chamber 224 of the upper heat sink 20 is located at a bottom end of the base 22 of the upper heat sink 20, facing the envelope 10 to receive the LED module 30 and the light guide plate 40 therein. Since the use of the two chambers 222, 224 in the base 22 of a lower heat sink 20 is similar to that of the two chambers 222, 224 in the base 22 of the upper heat sink 20, a detailed description thereof is omitted here for conciseness. Nevertheless, the chamber 224 is provided in a top end of the base 22 of the lower heat sink 20 and the chamber 222 is provided in a bottom end thereof. The base 22 includes a heat absorbing portion 226 located between the two chambers 222, 224 for separating the chamber 222 from the chamber 224. The heat absorbing portion 226 defines a through hole 2260 in a centre thereof for receiving a lead wire (not shown) therein to electrically connect the LED module 30 and the rectifier. The heat absorbing portion 226 also defines two pairs of mounting holes (not labeled) arranged in a line, and located near a rim thereof for providing passages of screws to thereby fix the LED module 30 and the light guide plate 40 on a surface of the heat absorbing portion 226 of the heat sink 20. The chamber 222 defines a concave, annular recess 228 at an upper opening (not labeled) thereof for engaging the cover 50 therein. The recess 228 has a diameter larger than that of the chamber 222 and communicates with the chamber 222. Three concaves 229 extend outwardly from a circumferential periphery of the recess 228 and each define a through hole 2290 for extension of a screw (not shown) therethrough to mount the cover 50 to the heat sink 20.

The LED modules 30 each are received in a corresponding chamber 224 and adhered on a corresponding heat absorbing portion 226. The LED module 30 comprises a circular printed circuit board (hereinafter PCB) 32 and three LEDs 34 mounted on the PCB 32. The LED modules 30 each define a through hole 36 in a central portion thereof for extension of the lead wire therethrough to connect with the LEDs 34. The LED module 30 also defines a pair of fixing holes 38 corresponding to the through holes of the heat absorbing portion 226, located near a rim of the PCB 32, for extension of screws (not shown) therethrough to secure the LED module 30 on the heat absorbing portion 226 of the heat sink 20. At this secured position, the LED modules 30 are located within a periphery of the through hole 102 of the envelope 10.

Each light guide plate 40 is received in the corresponding chamber 224 and adhered on the corresponding heat absorbing portion 226. The light guide plate 40 comprises a circular plate (not labeled) and an annular protrusion 42 extending perpendicularly from a rim of the circular plate and toward the corresponding heat sink 20, three circular through holes 440 are defined in the light guide plate 40 corresponding to the three LEDs 34 mounted on the LED module 30, for receiving the LEDs 34 mounted on the LED module 30 therein. A diameter of the through hole 440 gradually increases along a direction from the circular plate toward the envelope 10; thus, an annular chamfer 44 is formed at an inner periphery of each through hole 440. The light guide plate 40 has a thickness the same as a depth of the chamber 224 of the heat sink 20. The light guide plate 40 defines two fixing holes (not labeled) corresponding to the through holes of the heat absorbing portion 226, located near a rim thereof, for extension of screws (not shown) therethrough to secure the light guide plate 40 on the heat absorbing portion 226 of the heat sink 20.

The cover 50 is generally circular and plate-shaped and forms three flanges 52 extending outwardly from a circumferential periphery thereof. The flanges 52 each define a fixing hole 520 corresponding to the through hole 2290 of the heat sink 20 for extension of three screws (not shown) therethrough to secure the cover 50 on the heat sink 20. A protruding support 54 extends upwardly from a central portion of the cover 50. A hollow shaft 540 with threads formed thereon is fixed on a centre of the protruding support 54 for fixing the LED lamp to a lamp holder (not shown). The shaft 540 can also allow the lead wire to extend therethrough to connect with the LED modules 30.

In assembly of the LED lamp, the LED modules 30 are received in the corresponding chambers 224 and attached on the corresponding heat absorbing portions 226. The light guide plates 40 are disposed in the chambers 222 to engage with the corresponding LED modules 30. At this engaged position, the LEDs 34 of the LED modules 30 are exposed from the light guide plates 40 and surrounded by the chamfers 44. The covers 50 each are received in the corresponding chamber 222 with the flanges 52 engaging in the concaves 229 of the heat sinks 20 respectively. The screws (not shown) extend through the fixing holes 520 of the covers 50 and the through holes 2290 of the heat sinks 20 to threadedly engage in the fixing holes 160 of the envelope 10 to thereby assemble these components together.

In use of the LED lamp, the light generated by the LED modules 30 is reflected by the chamfers 44 of the adjacent light guide plates 40 to move to the through hole 102 of the envelope 10. The light in the through hole 102 spreads over an interior of the envelope 10 defining the through hole 102. From the interior the light radiates outward to an environment surrounding the LED lamp via an exterior of the envelope 10. Since the light emitted by the LEDs 34 of the LED lamp does not directly radiate to the outside of the LED lamp, but is reflected by the light guide plates 40 firstly and then radiate to the outside of the LED lamp via a diffusion and spreading of the envelope 10 which is located between the light guide plates 40, the concentrated, discrete, beam-distributed light produced by the LEDs 34 of the LED modules 30 can be transformed into a uniform, three-dimensional light source radiating in a variety of directions of the lamp. Thereby, an illumination area of the LED lamp is increased and the disadvantages of the light glare, concentrated light beams and blackout of users of the LED lamp are accordingly improved. Besides, the LED modules 30 are received in the heat sinks 20 and adhered on the heat absorbing portions 226 of the heat sinks 20, the heat sinks 20 can dissipate the heat generated by the LED modules 30 into ambient air rapidly and sufficiently.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp, comprising:

an envelope which defines a through hole in a central portion thereof;

two heat sinks respectively disposed at two opposite ends of the envelope;

two LED modules respectively received in the two heat sinks; and two light guide plates respectively abutting against corresponding LED modules and received in the two heat sinks, wherein light emitted from the LED modules is reflected by the light guide plates firstly into the through hole of the envelope and then spreads on the envelope to radiate to an outside of the LED lamp through the envelope.

2. The LED lamp as claimed in claim 1, wherein the two heat sinks each define a first chamber facing the through hole of the envelope and a second chamber opposite to the through hole of the envelope, and comprises a heat absorbing portion separating the first chamber from the second chamber.

3. The LED lamp as claimed in claim 2 further comprising two covers respectively mounted on the second chambers of the two heat sinks.

4. The LED lamp as claimed in claim 2, wherein the two LED modules and the two light guide plates are respectively received in the first chambers of the heat sinks.

5. The LED lamp as claimed in claim 2, wherein the two light guide plates each have a thickness identical to a depth of the first chamber of the each of the two heat sinks.

6. The LED lamp as claimed in claim 2, wherein the two LED modules are secured to the heat absorbing portions of the two heat sinks and each comprise a PCB and a plurality of LEDs mounted on the PCB.

7. The LED lamp as claimed in claim 1, wherein the two light guide plates each have through holes defined therein for receiving the LEDs, an inner surface of the each of the through holes in the two light guide plates being slantwise.

8. The LED lamp as claimed in claim 1, wherein the two heat sinks and the envelope each have a triangular, prism-shaped configuration.

9. The LED lamp as claimed in claim 1, wherein the two heat sinks each comprise a base and a plurality of fins extending perpendicularly and outwardly from an outer periphery of the base.

10. The LED lamp as claimed in claim 1, wherein the envelope defines three through holes around the through hole defined in a centre of the envelope.

11. An LED lamp comprising:

an envelope;

a heat sink mounted at an end of the envelope; and an LED module received in the heat sink, wherein light emitted from the LED module is oriented toward the envelope to spread out of the LED lamp from the envelope and, wherein the envelope defines a through hole therein and light emitted from the LED radiates into the through hole.

12. The LED lamp as claimed in claim 11 further comprising a reflective plate mounted in the heat sink, wherein the LED module is sandwiched between the reflective plate and the heat sink.

13. The LED module as claimed in claim 11 further comprising a cover mounted in the heat sink, wherein the cover and the LED module are separated by an interlayer of the heat sink.

14. The LED module as claimed in claim 11, wherein the heat sink comprises a plurality of fins arranged at a periphery thereof.

15. The LED module as claimed in claim 11, wherein the periphery of the heat sink is coincidental with that of the envelope.

16. The LED module as claimed in claim 11, wherein the envelope is triangular, prism-shaped.

17. An LED lamp comprising:

an envelope;

a heat sink mounted at an end of the envelope;

an LED module received in the heat sink, wherein light emitted from the LED module is oriented toward the envelope to spread out of the LED lamp from the envelope; and a reflective plate mounted in the heat sink, wherein the LED module is sandwiched between the reflective plate and the heat sink.

* * * * *